US006712355B2

(12) United States Patent
Nakaoda et al.

(10) Patent No.: US 6,712,355 B2
(45) Date of Patent: Mar. 30, 2004

(54) METHOD AND APPARATUS FOR LOCATING AND CONVEYING SHEET-LIKE BODY

(75) Inventors: Toshinori Nakaoda, Aichi (JP); Teruaki Aoto, Aichi (JP)

(73) Assignee: Meinan Machinery Works, Inc., Obushi (JP)

( * ) Notice: Subject to any disclaimer, the term of this patent is extended or adjusted under 35 U.S.C. 154(b) by 0 days.

(21) Appl. No.: 10/219,346

(22) Filed: Aug. 16, 2002

(65) Prior Publication Data

US 2003/0047865 A1 Mar. 13, 2003

(30) Foreign Application Priority Data

Sep. 7, 2001 (JP) ..... 2001-271273

(51) Int. Cl.[7] ..... B65H 9/00

(52) U.S. Cl. ..... 271/236; 271/227; 271/234; 271/245; 271/250

(58) Field of Search ..... 271/236, 226, 271/227, 229, 230, 234, 235, 245, 250

(56) References Cited

U.S. PATENT DOCUMENTS 5,219,159 A * 6/1993 Malachowski et al. ..... 271/228
5,335,904 A 8/1994 Ryuzaki
5,678,159 A * 10/1997 Williams et al. ..... 271/236
5,937,260 A * 8/1999 Taninaka et al. ..... 271/240
6,011,948 A * 1/2000 Amano et al. ..... 271/245
6,059,284 A * 5/2000 Wolf et al. ..... 271/227
6,264,196 B1 * 7/2001 Lotsch ..... 271/228

FOREIGN PATENT DOCUMENTS

GB 110202 10/1917

OTHER PUBLICATIONS

Patent Abstracts of Japan, JP 60002546 (Jan. 8, 1985).
Patent Abstracts of Japan, JP 05124752 (May 21, 1993).

* cited by examiner

*Primary Examiner*—Douglas Hess
(74) *Attorney, Agent, or Firm*—Armstrong, Kratz, Quintos, Hanson & Brooks, LLP

(57) ABSTRACT

A method for locating and conveying a veneer sheet includes: causing a downstream end of a veneer sheet conveyed by a travelling conveying member to abut against a blocking member to correct the attitude of the veneer sheet in such a state that a downstream end of the veneer sheet is perpendicular to the conveying direction of the veneer sheet; and after moving the conveying member in a direction perpendicular to the conveying direction until one side end of the veneer sheet perpendicular to the conveying direction reaches a predetermined position and stopping the conveying member, moving the blocking member to a position where the blocking member does not abut against the veneer sheet. Accordingly, attitude correction of a veneer sheet and locating thereof in the direction perpendicular to the conveying direction can be performed effectively.

11 Claims, 19 Drawing Sheets

METHOD AND APPARATUS FOR LOCATING AND CONVEYING SHEET-LIKE BODY

BACKGROUND OF THE INVENTION

1. Field of the Invention

The present invention relates to a method and apparatus for locating and conveying a sheet-like body where, when a sheet-like body such as a veneer sheet (hereinafter, referred to as a veneer sheet) or the like is conveyed to a downstream or next step, the attitude of the sheet-like body is corrected to a state where a downstream or leading end portion of the sheet-like body in a conveying direction thereof is generally perpendicular to the conveying direction, and one end portion of the sheet-like body in a direction perpendicular to the conveying direction thereof is aligned at a predetermined position and located.

2. Description of the Related Art

Conventionally, an apparatus which, when a veneer sheet is conveyed to the next step, positions a downward side ed or leading end of the veneer sheet in a conveying direction thereof in a state where it is generally perpendicular to the conveying direction and aligns one side end portion of the veneer sheet at a predetermined position, thereby locating the veneer sheet has been proposed in, for example, Japanese Patent Publication 01-14138.

As shown with a schematic plan view in FIG. 19, this apparatus is provided on a conveying-out side, or on a right side in the drawing, of a known adhesive applying machine 1 with a pair of upper and lower rolls for applying adhesive to a surface and a back surface of a veneer sheet 2 with conveyors 3 comprising a plurality of disc-like rolls which have axial center lines in a direction perpendicular to a conveying direction for conveying a veneer sheet in left and right directions and which are driven in forward and reverse directions, a stopper 4 which is movable between a position where it abuts against the veneer sheet conveyed by the conveyors 3 to block movement thereof and a position where it does not abut against the veneer sheet positioned below, a detector 5 which detects that the upstream side end of the veneer sheet 2 in the conveying direction has passed a position of the stopper 4, a stinging and holding member 9 which has many needle-like members to sting the veneer sheet 2 from a surface side thereof and which are continuously arranged in a direction perpendicular to the conveying direction of the veneer sheet 2, the stinging and holding member 9 being movable in upward and downward directions and left and right directions shown with arrows in FIG. 19 and being capable of being ascended and descended between a position where the needle-like members sting a veneer sheet and a position where the stinging and holding member 9 does not abut against a veneer sheet, and a detector 30 which detects one side end portion of a veneer sheet in a direction perpendicular to the conveying direction of the veneer sheet.

In the apparatus, the pair of rolls of the adhesive applying machine 1 and the conveyors 3 are respectively driven so as to convey a veneer sheet 2 in the right direction, the stopper 4 is caused to stand by at the position where it does not abut against a veneer sheet and the stinging and holding member 9 is further caused to stand by at an illustrated position where it does not abut against a veneer sheet. In this state, the veneer sheet 2 positioned on the left side of the adhesive applying machine 1 is fed into the adhesive applying machine 1 such that a conveying direction of the veneer sheet 2 corresponds to a grain or fiber direction of the veneer sheet. The veneer sheet 2 is applied with an adhesive on its both sides and it is fed out to the conveyors 3 and is thereafter conveyed by the conveyors 3. When it is detected by the detector 5 that the upstream side end or a trailing end of the veneer sheet 2 has passed the position of the stopper 4, the conveyors 3 are stopped and the stopper 4 is ascended up to a position where it abuts against the veneer sheet. Next, when the conveyors 3 are reversely rotated to convey the veneer sheet in the reverse direction, the entire upstream side end or trailing end of the veneer sheet 2 is caused to abut against the stopper 4 such that the attitude of the veneer sheet 2 is corrected. Next, after the stinging and holding member 9 is descended to sting and hold the veneer sheet 2, the stinging and holding member 9 is ascended, and it is moved in the right direction on FIG. 19 and is also moved upward. When the detector 30 detects the one side end portion of the veneer sheet 2 by the movements, the upward movement of the stinging and holding member 9 is stopped and the member 9 is moved only in the right direction. When the veneer sheet 2 reaches a predetermined position, the veneer sheet 2 is separated from the stinging and holding member 9 by a separating member (not shown). The veneer sheets 2 thus conveyed are stacked one on another in a state that the ends of the sheets 2 are generally aligned in an imaginary line L.

In the conventional apparatus, however, since such a constitution has been employed that the veneer sheet which is being conveying is re-held by the stinging and holding member 9 and located, it takes an extra time for re-holding the veneer sheet, which is made it difficult to increase efficiency or productivity or efficiency.

SUMMARY OF THE INVENTION

In order to solve the above-described problem, according to one aspect of the present invention, there is provided a method for locating and conveying a sheet-like body, comprising the steps of causing a downstream side end portion of a sheet-like body conveyed by a travelling conveying member to abut against a blocking member to correct the attitude of the sheet-like body in such a state that the downstream side end of the sheet-like body is perpendicular to the conveying direction of the sheet-like body; moving the conveying member in a direction perpendicular to the conveying direction until one side end of the sheet-like body in the direction perpendicular to the conveying direction reaches a predetermined position and stopping movement of the conveying member in the direction perpendicular to the conveying direction; and moving the blocking member to a position where the blocking member does not abut against the sheet-like body.

According to another aspect of the invention, there is provided an apparatus for locating and conveying a sheet-like body, comprising: a conveying member which conveys a sheet-like body in a conveying direction by travelling thereof and which can reciprocate in an X direction perpendicular to the conveying direction; a moving mechanism which reciprocates the conveying member in the X direction; a blocking member which can reciprocate between a position where the blocking member abuts against the sheet-like body conveyed in the conveying direction by the conveying member to block conveyance of the sheet-like body and a position where the blocking member allows passing of the sheet-like body; a first detector which detects whether or not the downstream side end of the sheet-like body is positioned to abut against the blocking member which stands by at a position where the blocking member prevents the conveyance; a second detector which detects that one side end of the sheet-like body in the direction perpendicular to the conveying direction of the sheet-like body has reached the predetermined position by movement of the conveying member in the X direction effected by actuation of the moving mechanism; a controller which performs such control that both of moving the blocking member at the position where the blocking member allows passing of the sheet-like body and actuating the moving mechanism to move the conveying member in the X direction are simultaneously performed or either one thereof is first performed on the basis of a signal form the first detector which has detected the downward side end of the sheet-like body conveyed by the conveying member in the state where the blocking member stands by at the position where the blocking member prevents the conveyance, and the moving mechanism is then stopped on the basis of a signal from the second detector which has detected the sheet-like body.

Since the present invention has been constituted in the above manner, correction of the attitude of a sheet-like body and locating thereof in the direction perpendicular to the conveying direction of the sheet-like body can be performed effectively.

DETAILED DESCRIPTION OF THE PREFERRED EMBODIMENTS

An embodiment of the present invention will be explained with reference to FIGS. 1 to 3.

Figure 1:
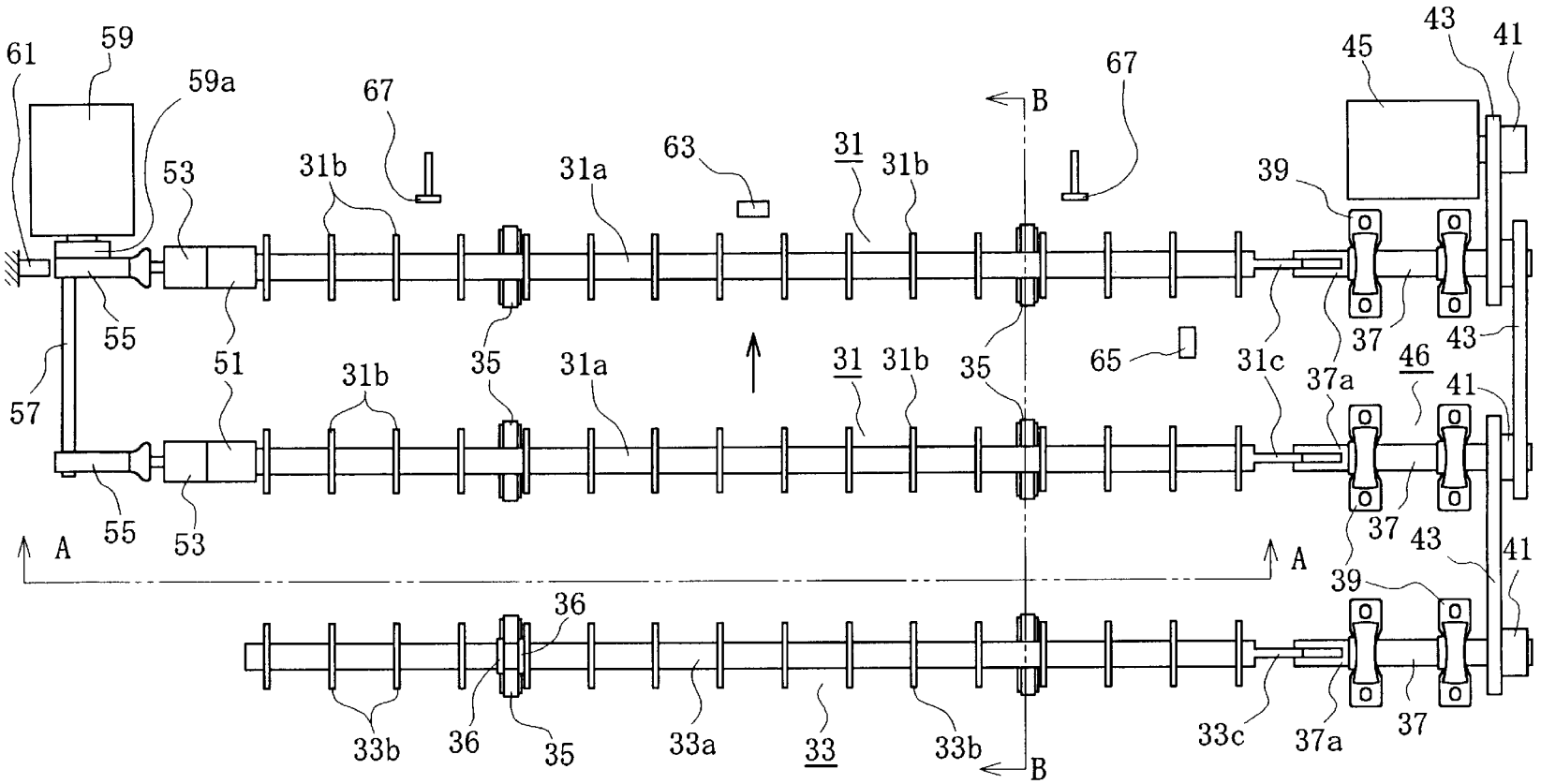
FIG. 1 is a plan view of an apparatus of an embodiment according to the present invention.
Figure 2:
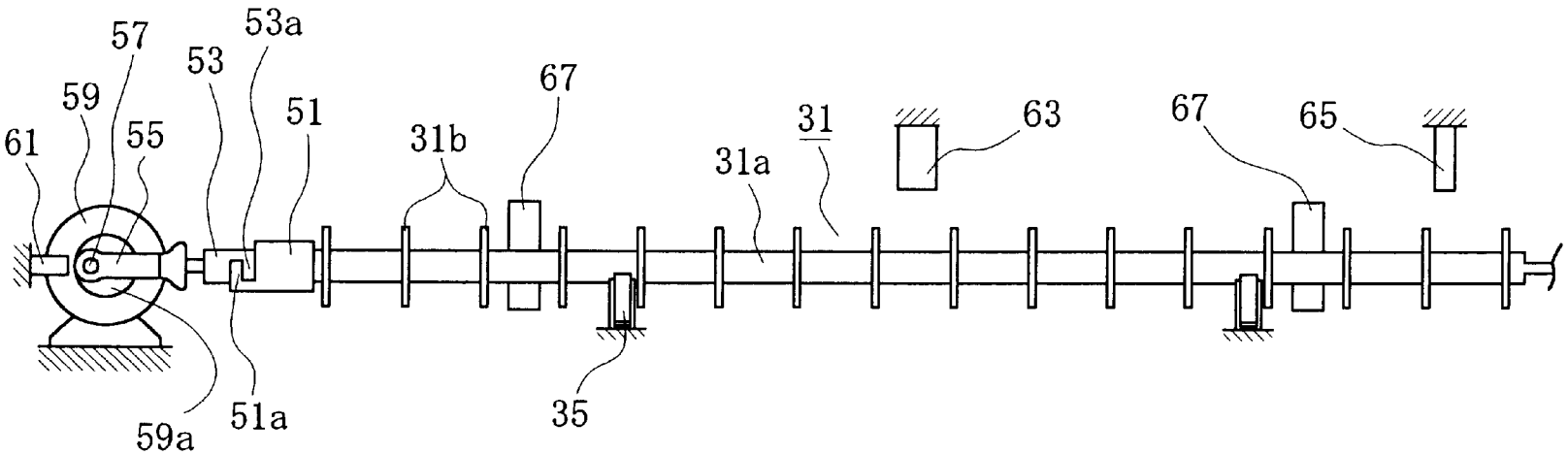
FIG. 2 shows a portion of the apparatus of FIG. 1 as view in an A—A direction of FIG. 1.
Figure 3:
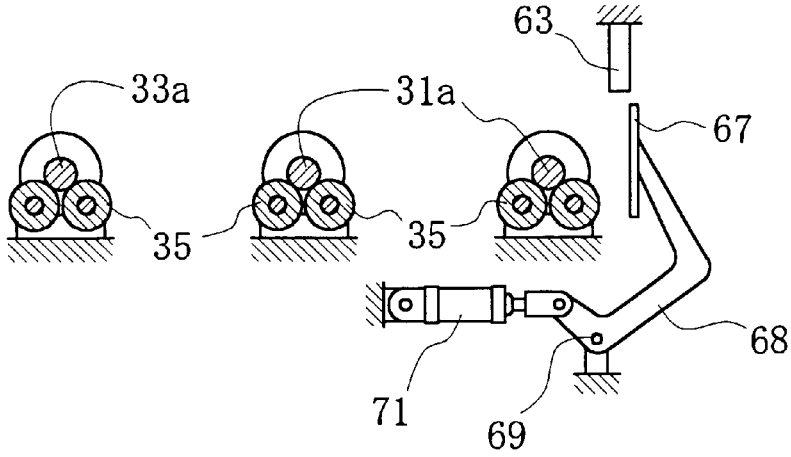
FIG. 3 shows a portion of the apparatus of FIG. 1 as view in a B—B direction of FIG. 1.

FIG. 1 is a plan view of an apparatus of the embodiment, FIG. 2 shows a portion of the apparatus of FIG. 1 as viewed in an A—A direction of FIG. 1, and FIG. 3 is a partial sectional and partial omitted view as viewed in a B—B direction of FIG. 1.

Reference numerals 31, 33 shown in FIG. 1 denote conveyors serving as conveying members to convey a substantially rectangular veneer sheet applied with an adhesive during the previous step (not shown) in an arrow direction. There are provided therein many discs 31*b*, 33*b* arranged on two shafts 31*a*, and one shaft 33*a* at proper intervals along center lines of the shafts 31*a*, 33*a*.

Also, as shown in FIG. 3, the shafts 31*a*, 33*a* are supported at their lower potions by outer peripheries of a pair of rotatable rolls 35 in order to reduce their flexures.

Furthermore, the right side end portions of the shafts 31*a*, 33*a* are cut into plate-like projecting portions 31*c*, 33*c* projecting in their axial directions.

Also, the shaft 33*a* is provided at its one portion with positioning collars 36 so as to sandwich the roll 35 at one position, such that the shaft 33*a* is restricted so as not to move in the axial center line direction.

Reference numeral 37 denotes a driving shaft formed with a recessed portion 37*a* which is engaged with one of the projecting portions 31*c*, 33*c* to transmit rotation to the one of the projecting portions 31*c*, 33*c*, and the driving shaft 37 is rotatably supported by bearings 39 and it is transmitted with rotation of a motor 45 via a sprocket 41 and a chain 43.

A shaft driving mechanism 46 is constituted by the above-described driving shaft 37, bearings 39, sprocket 41, chain 43, motor 45 and the like, and the conveyors 31, 33 are always rotated by the shaft driving mechanism 46 at a time of operation.

Provided on the left side end portion of each shaft 31*a* in FIG. 1 is an engagement body 51 which rotatably supports the shaft 31*a* which has an angular ball bearing (not shown) so as to move integrally in the axial center line direction according to rotation of a rotational shaft 59*a* of a motor 59 described later. As shown in FIG. 2, the engagement body 51 is provided with a flange portion 51*a* engaged with a joint 53 described later.

As shown in FIG. 2, reference numeral 53 is a joint having a flange portion 53*a* engaged with the flange portion 51*a* of the engagement body 51. The left side end portion of the joint 53 and the right side end portion of each arm 55 are pin-connected to each other such that the arm 55 is mounted to be pivotable about the left side end portion of the joint 53 according to rotation of a rotational shaft 59*a* described later. Also, as shown in FIG. 1, the left side end portion of each arm 55 is rotatably mounted via a bearing (not shown) to a connection rod 57 provided eccentrically to the rotational shaft 59*a* of the motor 59.

Reference numeral 61 denotes a detector such as a proximity sensor or the like, which is provided so as to correspond to one rotational shaft 31*a* and which outputs a detection signal when the rotational shaft 59*a* has rotated and the arm has moved to a position shown in FIG. 2, i.e., the arm 55 has moved to the leftmost position such that it is determined that the shaft 31*a* is positioned at an initial state where it has moved to the leftmost position.

The moving mechanism is constituted by the above-described engagement body 51, joint 53, arm 55, connection rod 57, motor 59, detector 61 and the like.

Reference numeral 63 denotes a detector such as a proximity sensor or the like, which is arranged on an upstream side, taken in a conveying direction of a veneer sheet, of a position where blocking members 67 described later are located on a conveying path constituted by the conveyors 31, 33 and upward of the conveyors 31, 33, and the detector 53 detects a downstream side end or a leading end of the veneer sheet being conveyed.

Reference numeral 65 denotes a detector such as a proximity sensor or the like which is arranged between the two shafts 31*a* above them, and it detects one side end of the veneer sheet taken in a direction perpendicular to the conveying direction of the veneer sheet, namely, a right side end of the veneer sheet in FIG. 1.

Reference numeral 67 denotes a blocking member which can be reciprocated between a raised position where it abuts against the veneer sheet being conveyed to block its conveyance and a lowered position where the blocking member allows passing of the veneer sheet. In this embodiment, two blocking members 67 are provided so as to be spaced from each other properly in a direction perpendicular to the conveying direction. As shown in FIG. 3, each blocking member is mounted to an upper and distal end of an arm 68 which is rotatably supported about a shaft 69. Then, two blocking members 67 are integrally moved to the both positions by the actuation of a cylinder 71.

Also, a controller (not shown) is provided so as to actuate the cylinder 71 and the motor 59 on the basis of respective signals from the detectors 65, 67 to control the blocking member 67 and the shafts 31*a*, respectively, as described later. Incidentally, a time T required for correcting the attitude of the veneer sheet described later is input and set in the controller in advance.

Since the embodiment of the present invention has been constituted in the above manner, its operation will be explained below.

In an initial state of an operation shown in FIG. 1, the both conveyors 31 stand by in a state where both the shafts 31*a* have been moved to the leftmost sides by rotating the rotational shaft 59*a* by the motor 59 and stopping the motor 59 when the arm 55 has been detected by the detector 61, and the conveyors together with the conveyor 33 are always being rotated by the shaft driving mechanism 46. Furthermore, the blocking members 67 stand by at the position where they block the conveyance of the veneer sheet by retracting operation of a rod of the cylinder 71, as shown in FIG. 3.

Figure 4:
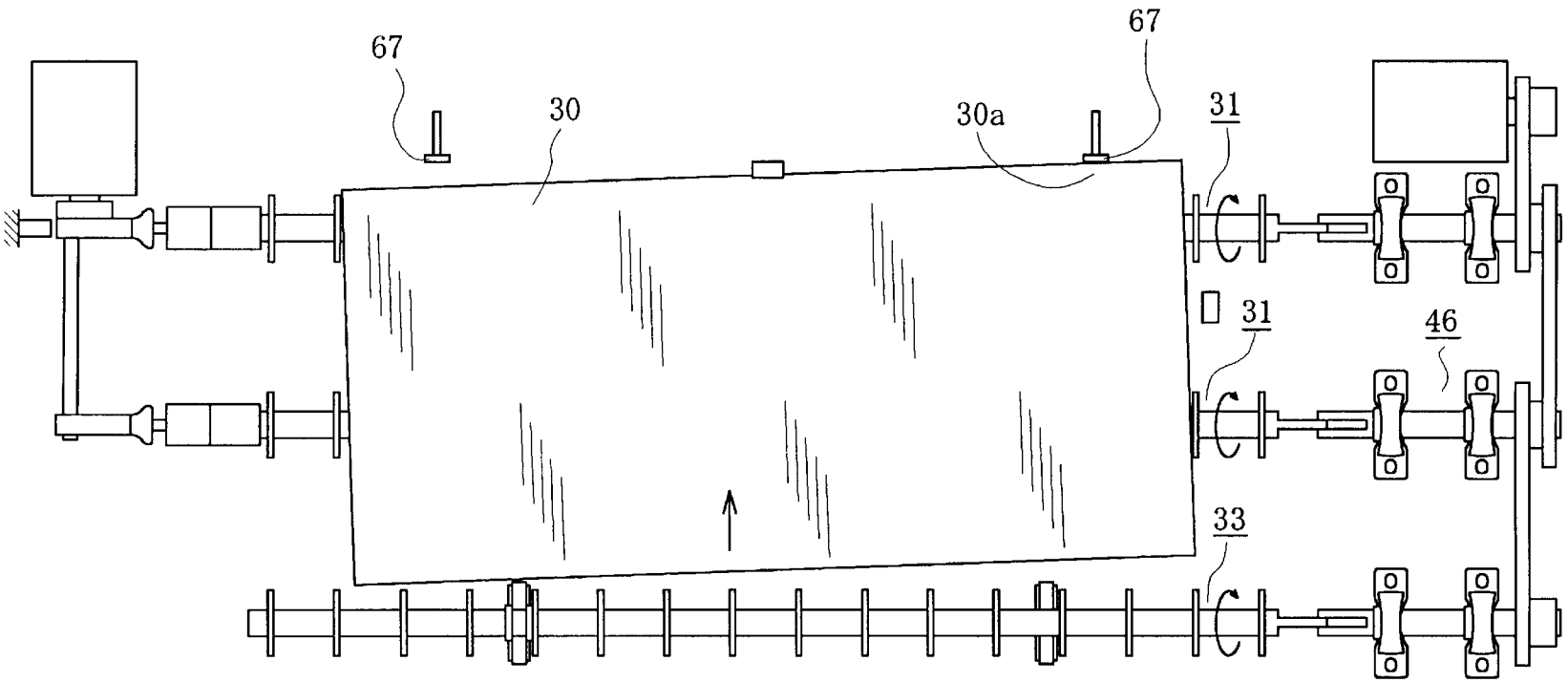
FIG. 4 is a view for explaining an operation of the apparatus of the embodiment.
Figure 5:
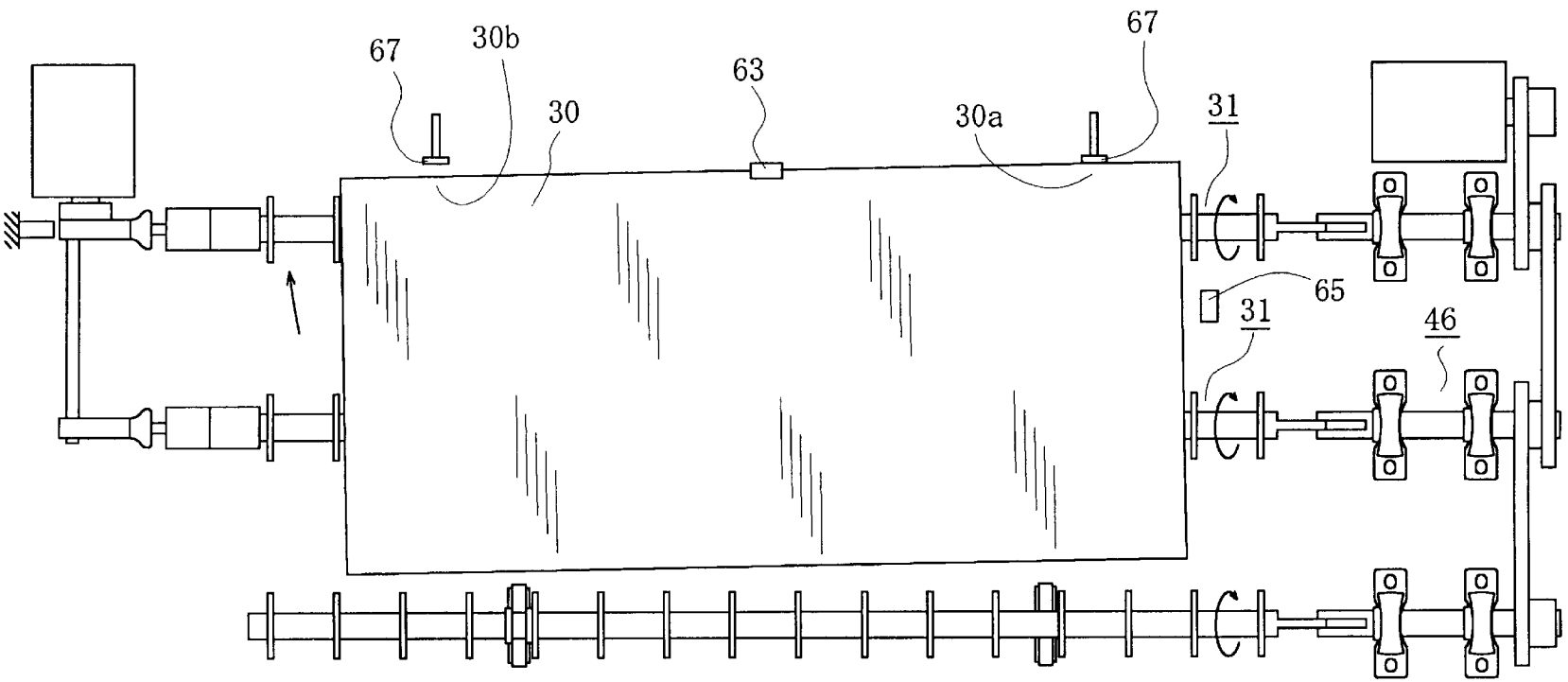
FIG. 5 is a view for explaining an operation of the apparatus of the embodiment.

In this state, as shown in FIG. 4, when the veneer sheet 30 is conveyed by the conveyors 31, 33 and, for example, a right side end portion 30*a* of the veneer sheet 30 which is positioned on the downward side in the conveying direction abuts against the blocking member 67 positioned on the right side, the veneer sheet 30 is rotated in an arrow direction about the left side end portion 30*a* by a conveying force of the conveyors 31, as shown in FIG. 5. When the left side end portion 30*b* of the veneer sheet 30 on the downstream side approaches to the blocking member 67 positioned on the left side, the detector 63 detects the veneer sheet 30 and its detection signal is input into the controller.

Figure 6:
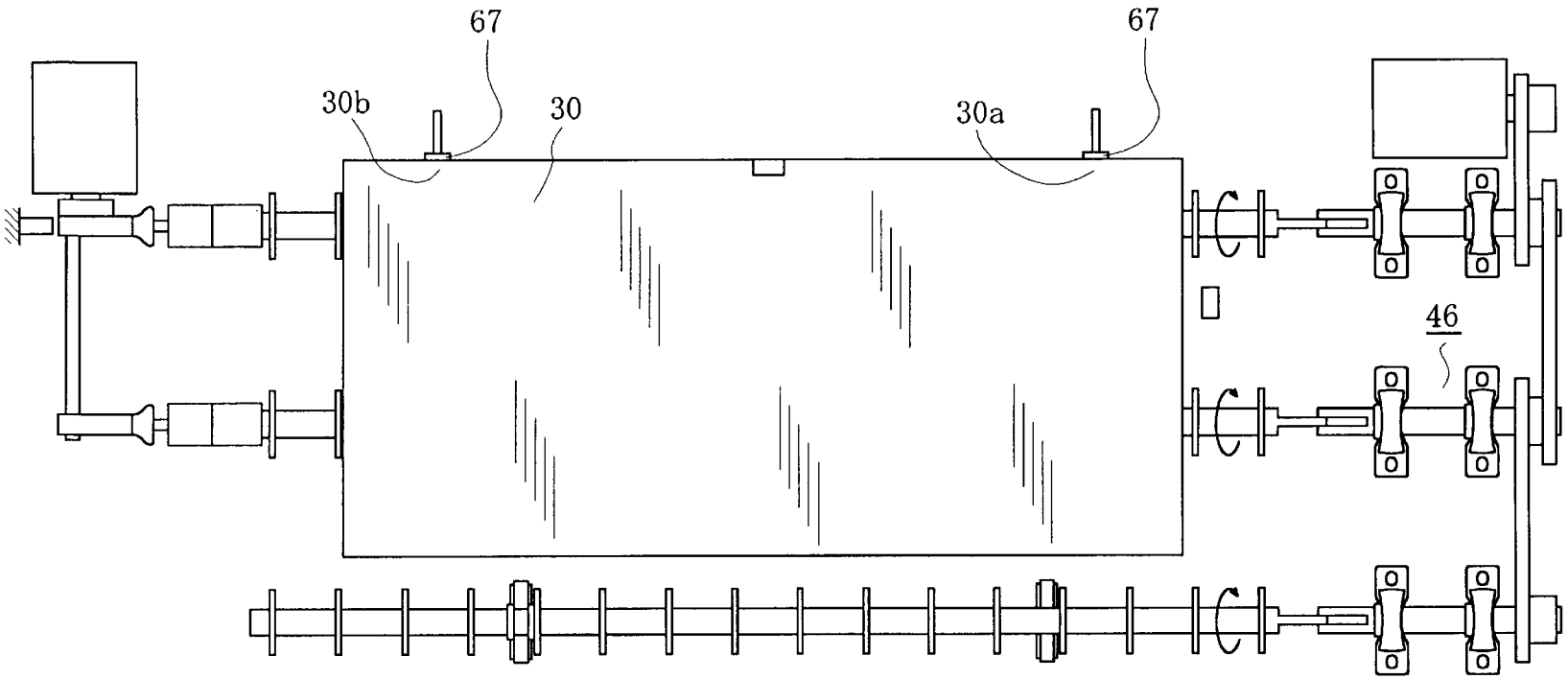
FIG. 6 is a view for explaining an operation of the apparatus of the embodiment.

When the veneer sheet 30 is further rotated, as shown in FIG. 6, the left side end portion 30*b* abuts on the left side control member 67 such that the rotation of the veneer sheet 30 is stopped and the attitude of the veneer sheet 30 is corrected.

Figure 7:
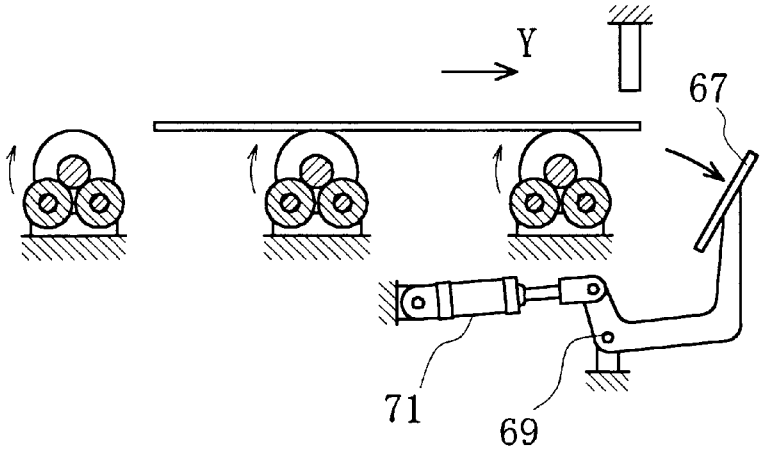
FIG. 7 is a view for explaining an operation of the apparatus of the embodiment.

After the time T required for correcting the attitude elapses from inputting of the detection signal to the controller, the rod of the cylinder 71 is extended according to a signal from the controller, as shown in FIG. 7 such that the blocking member 67 is rotated out of the conveying path downward, as shown with an arrow. There, the conveyance of the veneer sheet 30 is restarted by a conveying force from the conveyors 31, namely, the veneer sheet 30 is conveyed in a direction of arrow Y shown in FIG. 7.

Figure 8:
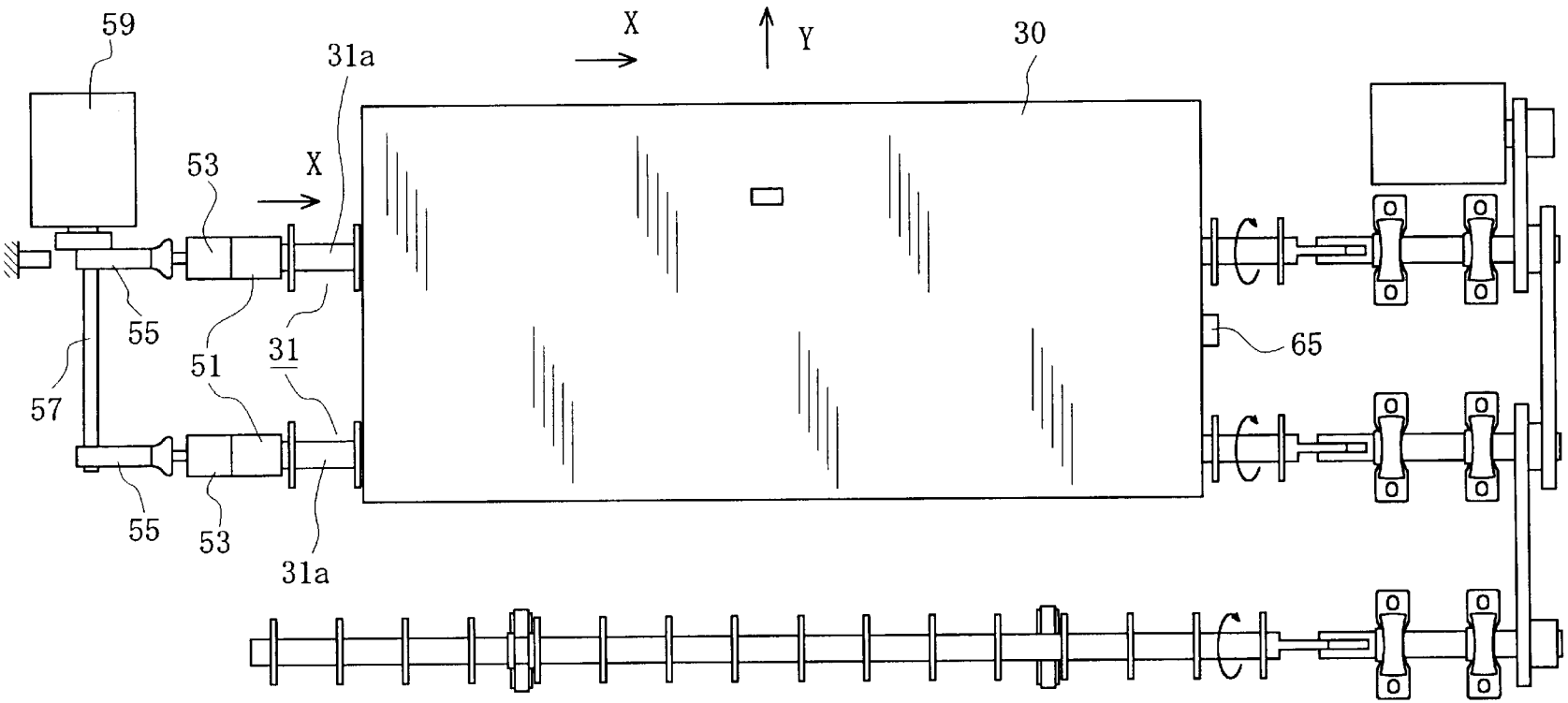
FIG. 8 is a view for explaining an operation of the apparatus of the embodiment.

Similarly, the motor 59 is rotationally driven according to a signal from the controller simultaneously with the conveyance in the direction Y. As shown in FIG. 8, the rotational shafts 31*a* which are rotated via the connection rod 57, the arms 55, the joints 53 and the engagement bodies 51 is moved to the left side, namely, the conveyors 31 are moved in a direction of arrow X.

As a result, the veneer sheet 30 is moved not only in the direction of arrow Y but also in the direction of arrow X in FIG. 8.

When the detector 65 detects the right side end of the veneer sheet 30 according to these movements, a detection signal is output and input into the controller.

Then, a signal for stopping the motor 59 is output from the controller such that the movement of the conveyors 31 in the direction X is stopped and locating of the left side end portion of the veneer sheet 30, i.e., the end portion thereof in the direction perpendicular to the conveying direction of the veneer sheet, is performed.

Figure 9:
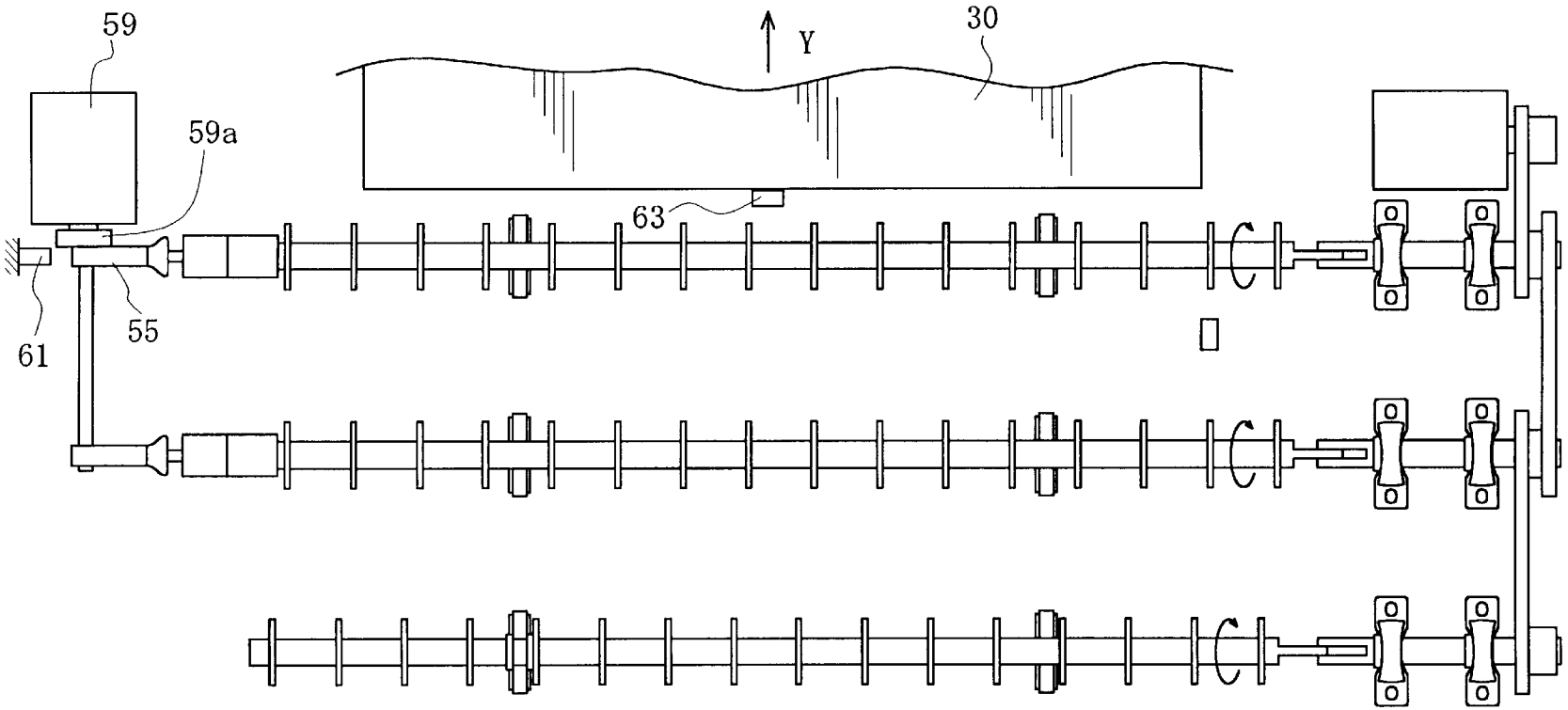
FIG. 9 is a view for explaining an operation of the apparatus of the embodiment.

A shown in FIG. 9, when the veneer sheet 30 is further conveyed in the direction of arrow Y and the upstream side end of the veneer sheet in the conveying direction passes a position where the detector 63 is disposed, a detection signal outputted from the detector 63 to the controller is stopped.

At this time, when a signal for rotationally driving the motor 59 is outputted to the controller and the rotational shaft 59*a* is rotated, the connection rod 57, the arms 55, the joints 53, the engagement bodies 51 and the conveyors 31 are moved to the left side in FIG. 9 to be returned back to their initial states such that the detector 61 detects the arm 55 at a position shown in FIG. 2. When a detection signal which has detected the arm 55 is inputted into the controller, a signal for stopping the motor 59 is outputted from the controller, the connection rod 57, the arms 55, the joints 53, the engagement bodied 51 and the conveyors 31 stop moving to the left side and they stand by in their initial positions. On the other hand, when a detection signal being outputted from the detector 63 is stopped, the controller outputs a signal for retracting the rod of the cylinder 71 to return the blocking member 67 to a position where it blocks the conveyance of a veneer sheet, as shown in FIG. 3.

The same operation as the above is repeated for each veneer sheet, whereby the attitude of each veneer sheet to be conveyed is corrected and the veneer sheet is located such that the veneer sheet is conveyed to the next step.

In the above embodiment, since the attitude correction of the veneer sheet and the locating thereof in the direction perpendicular to the conveying direction are performed by the above-described operation of the conveyors 31 supporting the veneer sheet, they can be performed in a short time with a simple constitution to improve productivity.

Also, even when the veneer sheet has been applied with adhesive, it is conveyed by the discs 31*b*, 33*b* such that loss of the adhesive applied to the veneer sheet can be reduced.

Furthermore, since the conveyors 31, 33 are constituted such that they can be detached without using any tool, even when the discs 31*b*, 33*b* has been applied with the adhesive, they can be detached and cleaned.

Incidentally, the embodiment described above may be modified in the following manner.

Figure 10:
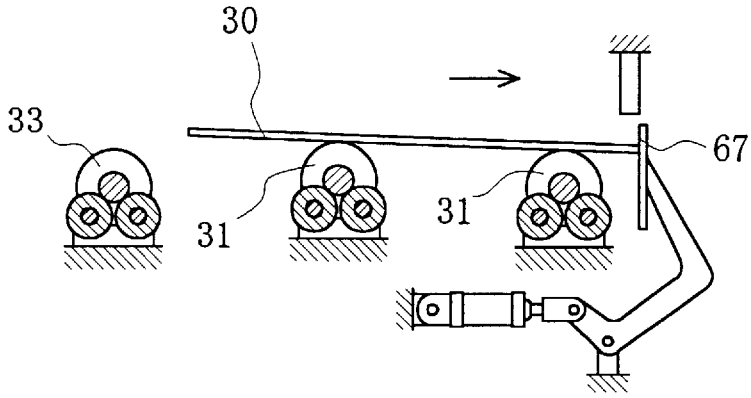
FIG. 10 is a view for explaining an apparatus of a partially modified embodiment.

1. In the above embodiment, the portions of the conveyors 31, 33 which support a veneer sheet are arranged so as to be positioned on substantially the same horizontal face, but such an arrangement can be employed that the portions of the conveyor 31 positioned on the upstream side in the conveying direction, which support a veneer sheet are higher than those of the conveyor 31 positioned on the downstream side in the conveying direction in order that a portion of a veneer sheet 30 which is positioned on the side of the blocking members 67 is inclined obliquely downward as shown in FIG. 10. By employing such an arrangement, a time elapsed from abutting of a veneer sheet 30 on the conveyors 31, 31 to one blocking member 67 to abutting thereof against the other blocking member 67 is shortened to further improve productivity.

2. In the embodiment, locating of a veneer sheet in the direction perpendicular to the conveying direction thereof is performed by moving two conveyors 31 in their axial central line directions by means of the moving mechanism constituted by the engagement bodies 51, the joints 53, the arms 55, the connection rod 57, the motor 59, the detector 61 and the like, but the following constitution can be employed.

Figure 11:
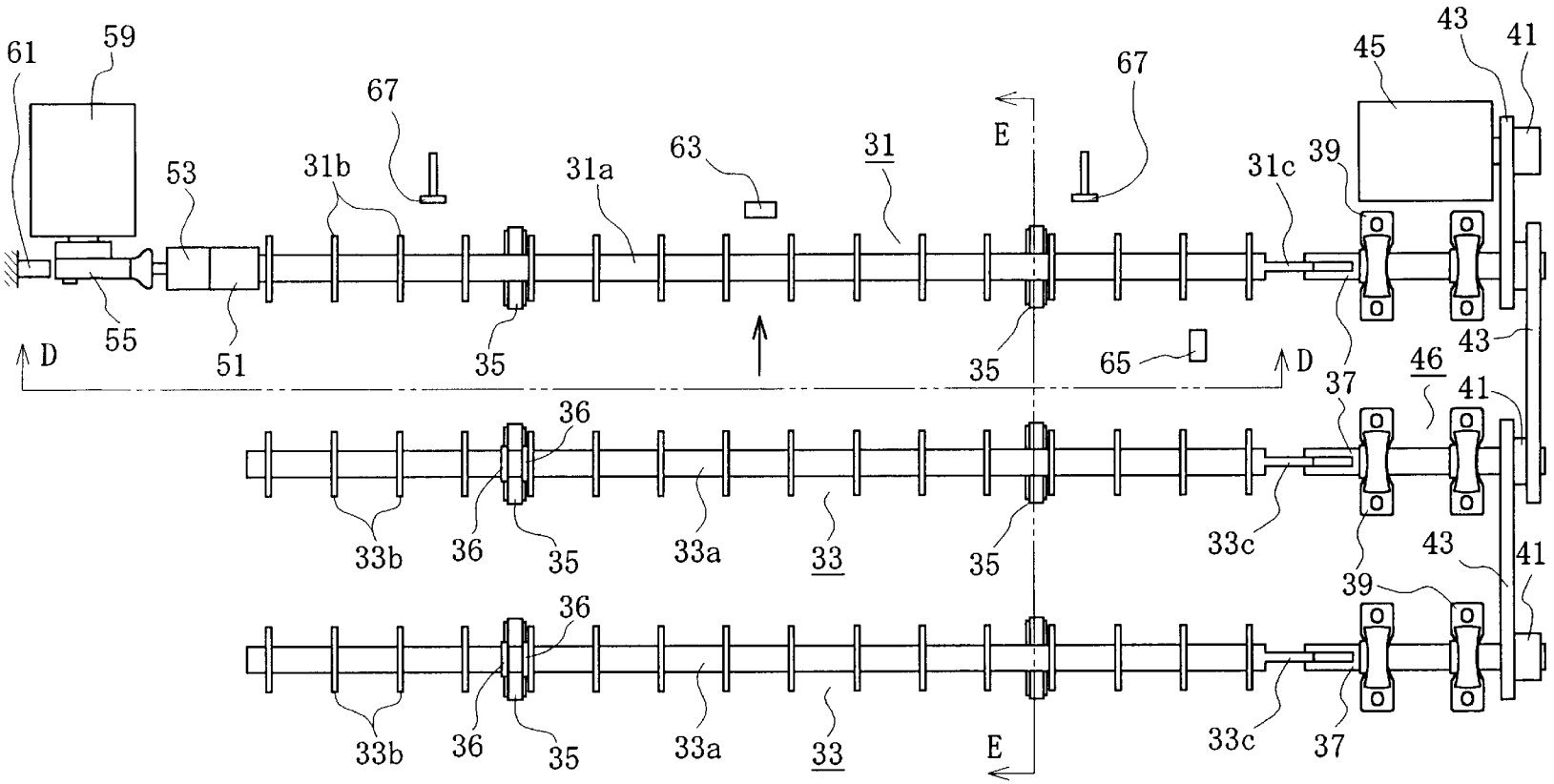
FIG. 11 is a plan view of the apparatus of the partially modified embodiment.

As shown with a plan view in FIG. 11, only one conveyor 31 movable in left and right directions by a moving mechanism constituted by an engagement body 51, a joint 53, an arm 55, a connection rod 57, a motor 59, a detector 61 or the like in the same manner as the embodiment is provided and a conveyor 33 similar to that of the embodiment is provided.

On the other hand, two pressing rolls 81, each of which holds a veneer sheet in cooperation with one disc 31*b* of the conveyor 31 and can be opened, are provided above the conveyor 31 although not shown so as to be spaced from each other in left and right directions.

Figure 12:
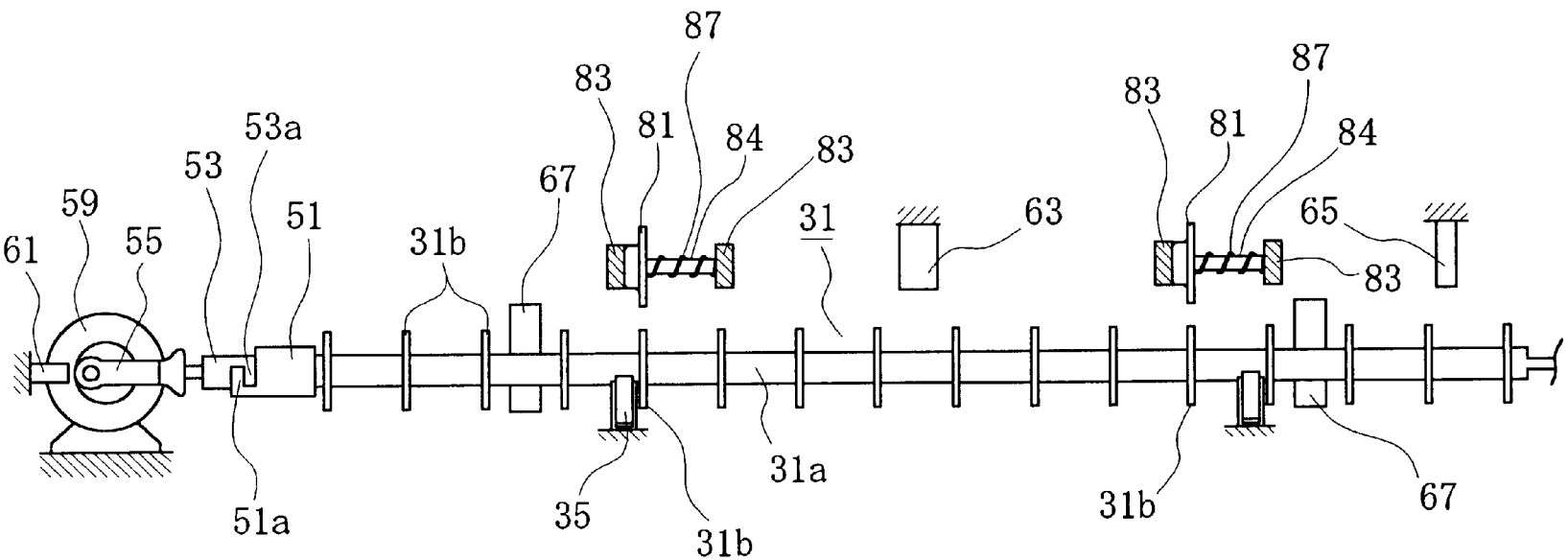
FIG. 12 shows a portion of the apparatus of FIG. 11 as viewed in a D—D direction of FIG. 11.

That is, as shown in FIG. 12 corresponding to a view as viewed in a D—D direction in FIG. 11, the pressing rolls 81 which are rotatable relative to the shaft 84 provided in a manner described later and are movable in their central line directions are arranged so as to be positioned just above two discs 31*b* selected from the discs of each conveyor 31 when the pressing rolls 81 are positioned to the left ends of the shafts 84 by compression springs 87 described later.

Figure 13:
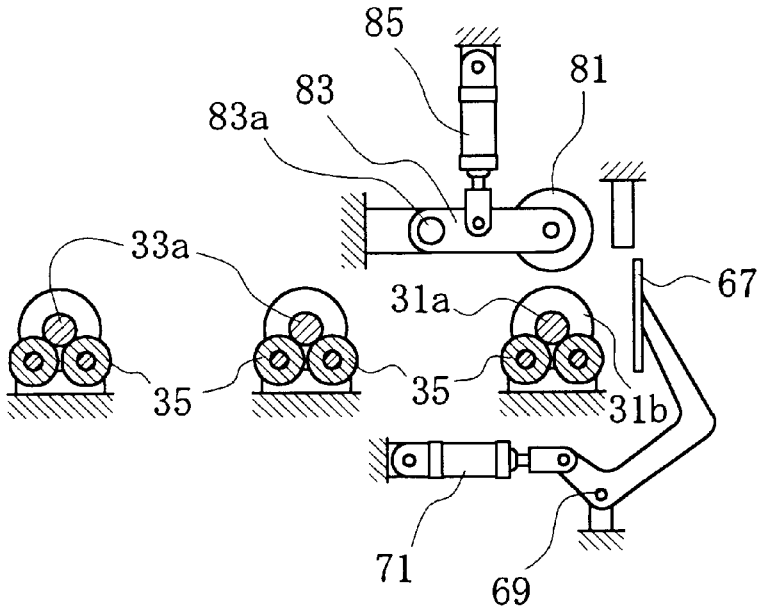
FIG. 13 shows a portion of the apparatus of FIG. 11 as viewed in an E—E direction of FIG. 11.

As shown in FIG. 13 corresponding to a view as viewed in an E—E direction in FIG. 11, each shaft 84 is fixed to a distal end of one of the two arms 83 rotatable about the rotational shaft 83*a*, and the arm 83 is rotated together with the shaft 84 by actuation of the cylinder 85.

Also, a resilient member whose strength has been considered, for example, a coil-like compression spring 87, is provided in a state where it has been slightly deformed in a compressed manner so as to cover the shaft 84 such that, when each pressing roll 81 is not subjected to an external force acting in a horizontal direction, the pressing roll 81 is put at an initial state shown in FIG. 12, or it is positioned to the left end of the shaft 84, and, when the conveyor 31 moves in the axial central line direction in a state where a veneer sheet has been held between the pressing roll 81 and the disc 31*b*, as described later, the pressing roll 81 can be moved together by a frictional force received from the conveyor 31 via the veneer sheet.

Portions of this modified embodiment other than the above portions are constituted in the same manner as those in the embodiment, and locating in the direction perpendicular to the conveying direction are performed according to the following operations of respective members.

Figure 14:
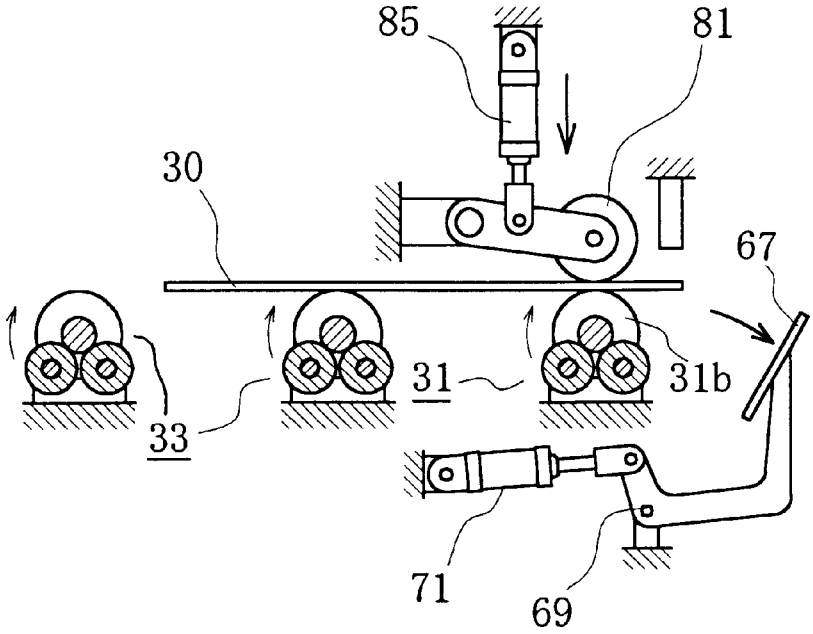
FIG. 14 is a view for explaining an operation of the apparatus of the partially modified embodiment.

Both the pressing rolls 81 are ascended by retracting operations of the cylinders 85 and they are caused to stand by, as shown in FIG. 13, the conveyors are caused to stand by in the initial state shown in FIG. 12, and a veneer sheet 30 is conveyed by the conveyors 31, 33 like the above embodiment. Then, after the downstream side end of the veneer sheet 30 in the conveying direction abuts against the two blocking members 67 and the attitude of the veneer sheet is corrected, the blocking members 67 are rotated in a direction of arrow to the outside of the conveying path by extending operations of the cylinders 71, as shown in FIG. 14.

Also, simultaneously with the extending operations of the cylinders 71, the rods of the respective cylinders 85 are extended to lower the pressing rolls 81 so that the veneer sheet 80 is held between the discs 31*b* and the pressing rolls 81.

Figure 15:
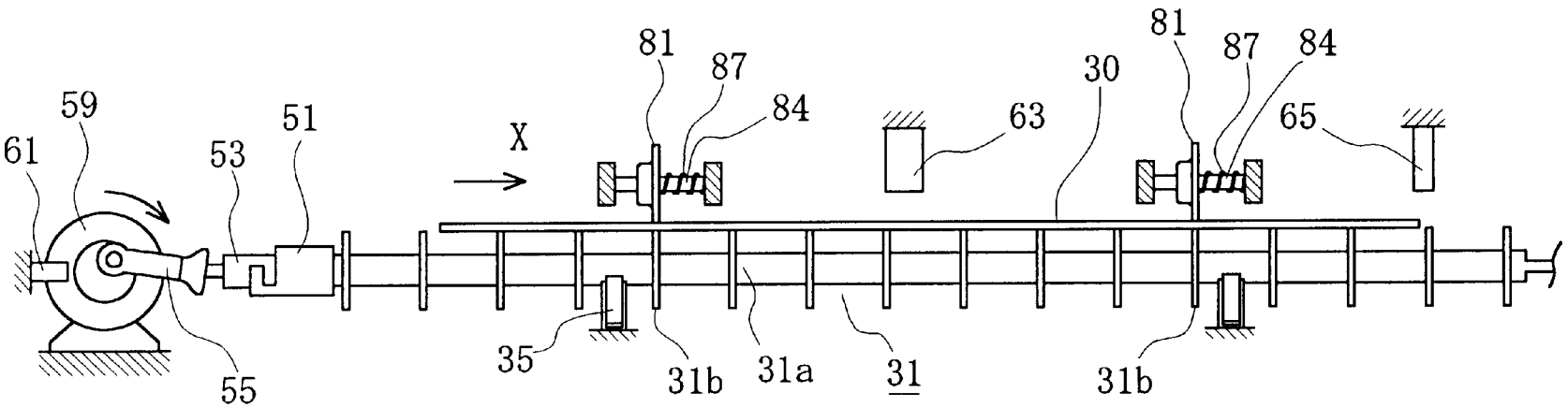
FIG. 15 is a view for explaining an operation of the apparatus of the partially modified embodiment.

Next, the motor 59 is rotationally driven in an arrow direction like the embodiment such that one conveyor 31 is moved in the direction of arrow X, as shown in FIG. 15. The veneer sheet 30 is conveyed in the direction Y shown in FIG. 8 according to rotation of the discs 31*b* and it is also moved in the direction X according to movement of the discs 31*b* to the direction X. For this reason, the pressing rolls 81 which have been brought into pressure-contact with the veneer sheet 30 are rotated by frictional force from the veneer sheet 30 and they are moved in the direction X along the shafts 84 together with the veneer sheet 30 while deforming the compression springs 87 in a compressing manner.

Next, when the detector 65 detects the right side end portion of the veneer sheet 30 moving in the direction Y shown in FIG. 7 and in the direction X, a detection signal is input to the controller and the motor 59 is stopped according to a signal from the controller. As a result, the locating of the veneer sheet 30 in the direction perpendicular to the conveying direction is performed.

Next, when the upstream side end of the veneer sheet 30 in the conveying direction passes the detector 63 according respective operations similar to those in the embodiment, any detection signal is not outputted from the detector 63 to the controller such that the motor 59 is rotationally driven according to a signal outputted from the controller and the rods of the cylinders are retracted to ascend the pressing rolls 81 from the state shown in FIG. 14. Like the embodiment, the conveyor 31 is moved to the initial state and is caused to stand by, and the pressing rolls 81 are returned back to one end of the initial state along the shafts 84 by forces of the compression springs 87 because external forces acting in a horizontal direction is cancelled.

In the above modified embodiments, since the veneer sheet 30 is moved in the conveying direction and in the direction perpendicular thereto in the state where it has been held between the discs 31*b* and the pressing rolls 81, the magnitude or valve of the frictional force acting from the discs 31*b* to the veneer sheet 30 can be increased such that accelerations to both the directions can be increased and productivity can further be improved by moving the veneer sheet in a shorter time.

3. In the modified embodiment where the pressing rolls 81 are provided, respective cylinders may be used as the returning members instead of the resilient members such as compression springs 87 or the like.

Figure 16:
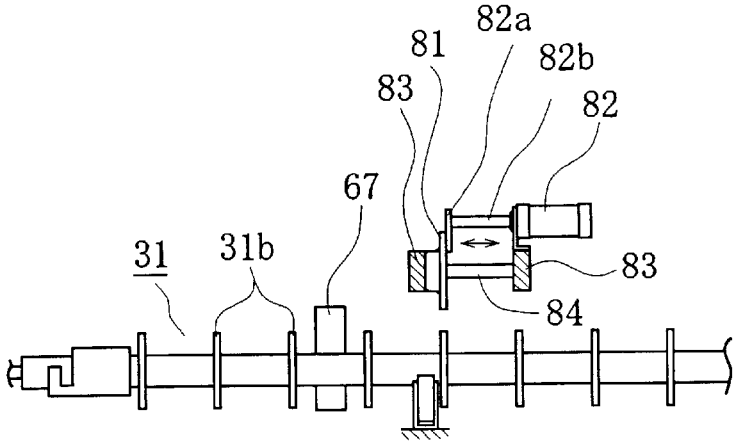
FIG. 16 is a view for explaining an apparatus of a partially modified embodiment.

That is, as shown in FIG. 16, a cylinder 82 provided at its rod 82*b* extendable/retractable in directions of arrows with a plate 82*a* in a state where the plate can abut against the pressing roll 81, and the cylinder 82 is rotated together with the arm 83 according to actuation of the cylinder 85.

In this case, in a state that the cylinder 82 has been retracted to retreat the rod 82*b* each time when the conveyor 31 returns back to the left side initial state shown in FIG. 16, when the conveyor 31 which has held the veneer sheet in cooperation with the pressing rolls 81 moves in the direction perpendicular to the conveying direction, namely, it moves in the right direction on FIG. 16 such that the pressing rolls 81 are moved in the right direction in the above-described manner, the pressing rolls 81 do not come in contact with the plates 82*a* and they are not subjected to any resistance from the plates 82*a*.

On the other hand, after the veneer sheet 30 held between the conveyor 31 and the pressing rolls 81 moves in the right direction and the detector 65 detects the right side end portion of the veneer sheet 30, when the upstream side end or the trailing end of the veneer sheet 30 in the conveying direction passes below the detector 63 according to respective operations similar to those in the above-described embodiment, the cylinder 85 effects its retracting operation according to a signal from the controller and the cylinder 82 effects its extending operation slightly thereafter. Thereby, the pressing rolls 81 ascend and then the plates 82*a* move to the right side in FIG. 16 such that the plates 82*a* abuts against the pressing rolls 81 to move the pressing rolls 81 along the axes 84 to their original positions on the left side.

Also, in order to prevent the pressing rolls 81 with a veneer sheet held in cooperation with the conveyor 31, which are moving in the direction perpendicular to the conveying direction from coming in contact with the plates 82*a*, such a timing can be employed as a timing for retracting the cylinders 82 that the pressing rolls 81 are descended for holding a veneer sheet in cooperation with the conveyor 31 and simultaneously the rod 82*b* are retracted.

4. In the above modified embodiment, the pressing rolls 81 holding a veneer sheet in cooperation with the conveyor 31 are provided as separate members, but the following constitution can be employed.

Figure 17:
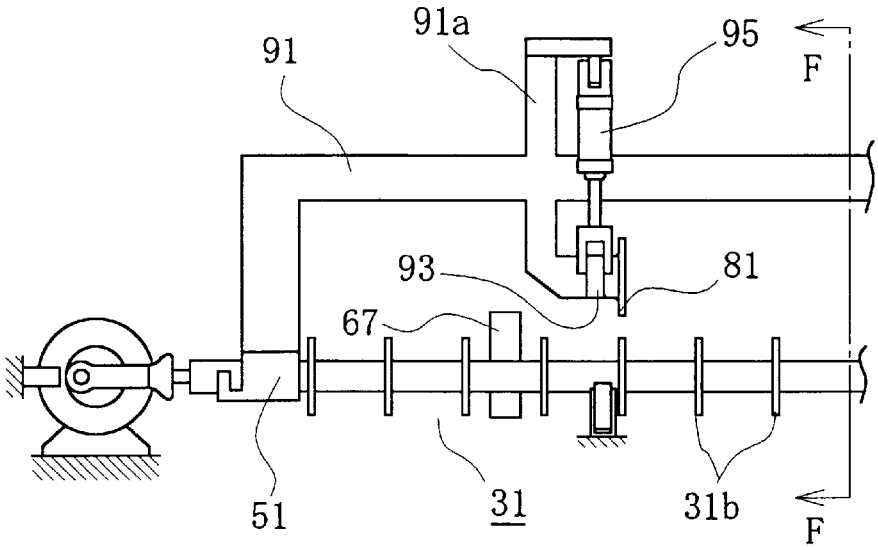
FIG. 17 is a view for explaining the apparatus of a partially modified embodiment.
Figure 18:
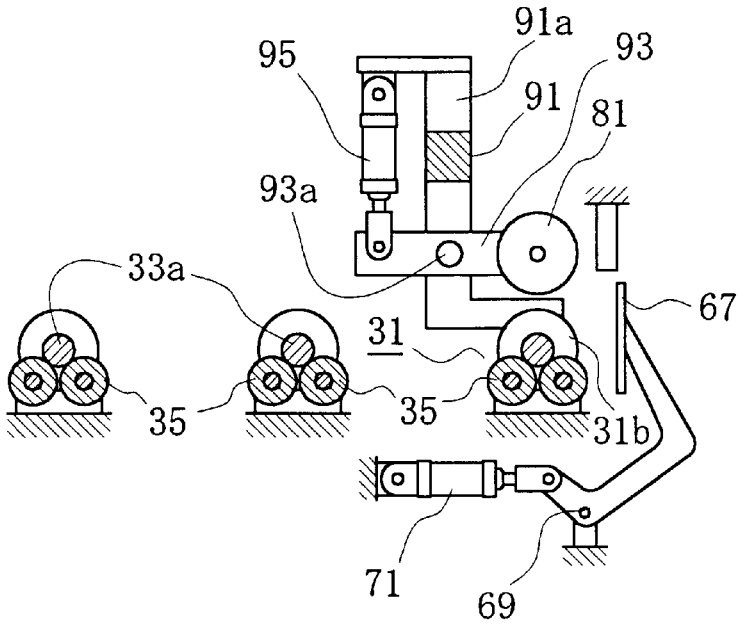
FIG. 18 is a portion of the apparatus of FIG. 17 as viewed in an F—F direction of FIG. 17.
Figure 19:
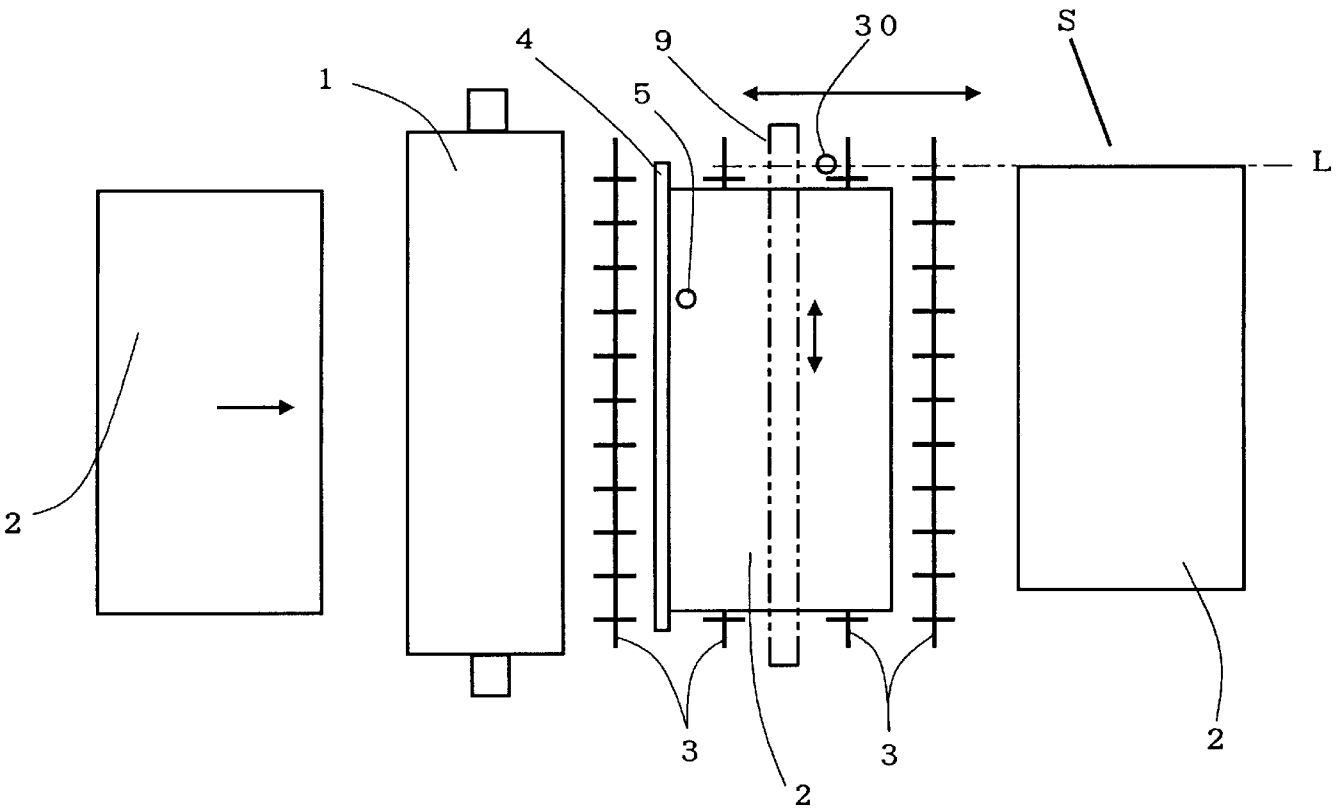
FIG. 19 is a plan view for explaining a prior art.

That is, as shown in FIG. 17 which is a partial front view corresponding to FIG. 12 and in FIG. 18 as viewed in an F—F direction of FIG. 17, a left side lower end of a gate-like auxiliary stand 91 is coupled to the engagement body 51 described in FIGS. 11 and 12, a right side lower end thereof is coupled to a shaft 31*a* of the conveyor 31 via a bearing (not shown), and a guide member (not shown) is provided such that the auxiliary stand 91 is always positioned at an illustrated position above the conveyor 31 and it is movable in left and right directions in FIG. 17.

A mounting stand 91*a* for arranging the pressing roll 81 just above one disc 31*b* is provided so as to extend in a vertically at a proper position in left and right directions in FIG. 17. An arm 93 rotatable about a shaft 93*a* is generally horizontally mounted to the mounting stand 91*a*, the arm 93 is provided at its right end with a pressing roll 81 similar to the above and is connected at an upper end of its left end to a distal end of a rod of a cylinder 95 coupled to the mounting stand 91*a*. As a result, the pressing roll 81 is reciprocated between a position where it holds a single in cooperation with the disc 31*b* and a position where it is separated from the veneer sheet according to retracting and extending operations.

In such a constitution, when a veneer sheet is conveyed in the direction perpendicular to the conveying direction, since the disc 31*b*, or the conveyor 31 and the pressing roll 81 are moved together with the conveyor 31, the movement of the veneer sheet is conducted almost without any resistance, and returning members such as the compression spring 87, the cylinder 82 and the like can be omitted.

5. In the above-described embodiment and modified embodiments, after the attitude of a veneer sheet has been corrected, for example, as shown in FIG. 7, a veneer sheet 30 is conveyed in the direction of arrow Y by extending the rods of the cylinders 71 to rotate the blocking members 67 in the direction of arrow to the outside of the conveying path and simultaneously it is conveyed in the direction of arrow X by rotationally driving the motor 59 shown in FIG. 8 to move the conveyors 31, which are rotating via the connection rod 57, the arms 55, the joints 53 and the engagement bodies 51, in the direction of arrow X.

Meanwhile, such a constitution can be employed that, after the attitude of a veneer sheet has been corrected, the blocking members 67 are first rotated in the direction of arrow to the outside of the conveying path to start conveyance of the veneer sheet 30 in the direction of arrow Y, and the motor 59 is then rotationally driven to move the conveyors 31 in the direction of arrow Y.

Also, such a constitution can be employed that, after the attitude of a veneer sheet 30 has been corrected, the motor 59 is first rotationally driven to start movement of the conveyors 31 in the direction of arrow X and the blocking members 67 are then rotated to the outside of the conveying path to convey the veneer sheet 30 in the direction of arrow Y.

6. In the above-described embodiment and modified embodiments, the conveyor 31 serving as the conveying member is always put in a rotating state, but it may be constituted such that it can be rotationally driven and stopped.

That is, in the modified embodiments explained with reference to FIGS. 15, 16, for example, the conveyor 31 is constituted so as to be capable of being rotationally driven and stopped, in which respective members are operated in the following manner.

After the veneer sheet conveyed by the conveyor 31 abuts against two blocking members 67 and the attitude thereof is corrected like the above-described embodiment, the conveyor 31 is first stopped so that conveyance of the veneer sheet is suspended. Next, after the pressing rolls 81 are descended to hold the veneer sheet in cooperation with the conveyor 31, the blocking members 67 are moved out of the conveying path. Then, rotational driving of the conveyor 31 is restarted and the conveyor 31 is moved in a direction perpendicular to the conveying direction of the veneer sheet so that locating of the veneer sheet in the direction X is completed. Thereafter, movement of the conveyor 31 in the direction perpendicular to the conveying direction is suspended.

Next, when the detector 63 detects that the veneer sheet held has passed through a predetermined position, the pressing rolls 81 are ascended according to a signal from the detector 63, and the conveyor 31 is then moved to its original or home position in a direction inverse to the direction perpendicular to the conveying direction. With such a configuration, the correction of the attitude of the veneer sheet can be performed excellently and effectively.

7. When the pressing roll 81 and the disc 31*d* of the conveyor 31 holding a veneer sheet therebetween are constituted to be wider in the axial central line direction than those in the embodiment and projecting portions are formed on peripheral faces of the pressing roll 81 and the disc 31*b*, locating of a veneer sheet can further securely be performed.

8. In the above embodiments, the conveyor 31 has been shown as one example of the conveying member, but such a constitution can be employed in this invention that a running or travelling body or member such as a belt, a chain or the like, which travels in the conveying direction of the veneer sheet is entrained between sprockets and the running body is movable in the direction perpendicular to the conveying direction like the above embodiments.

What is claimed is:

1. A method for locating and conveying a sheet-like body, comprising the steps of:

causing a downstream side end portion of a sheet-like body supported only at an underside thereof and conveyed by a travelling conveying member to abut against a blocking member to correct the attitude of the sheet-like body in such a state that the downstream side end of the sheet-like body is perpendicular to the conveying direction of the sheet-like body;

moving the conveying member in a direction perpendicular to the conveying direction until one side end of the sheet-like body in the direction perpendicular to the conveying direction reaches a predetermined position and stopping movement of the conveying member in the direction perpendicular to the conveying direction; and moving the blocking member to a position where the blocking member does not abut against the sheet-like body.

2. A method for locating and conveying a sheet-like body, comprising the steps of:

causing a downstream side end portion of a sheet-like body supported only at an underside thereof and conveyed by a travelling conveying member to abut against a blocking member to correct the attitude of the sheet-like body in such a state that the downstream side end portion of the sheet-like member is perpendicular to the conveying direction of the sheet-like body;

moving the blocking member to a position where the blocking member does not abut against the sheet-like body; and moving the conveying member in the direction perpendicular to the conveying direction until one side end of the sheet-like body in the direction perpendicular to the conveying direction reaches a predetermined position.

3. A method for locating and conveying a sheet-like body, comprising the steps of:

causing a downstream side end of a sheet-like body supported only at an underside thereof and conveyed by a travelling conveying member to abut against a blocking member to correct the attitude of the sheet-like body in such a state that the downstream side end of the sheet-like body is perpendicular to the conveying direction of the sheet-like body; and stopping traveling of the conveying member to move the conveying member in a direction perpendicular to the conveying direction until one side end of the sheet-like body in the direction perpendicular to the conveying direction reaches a predetermined position;

moving the blocking member at a position where the blocking member does not abut on the sheet-like body; and restarting travelling of the conveying member.

4. A method for locating and conveying a sheet-like body, comprising the steps of:

causing a downstream side end of a sheet-like body supported only at an underside thereof and conveyed by a travelling conveying member to abut against a blocking member to correct the attitude of the sheet-like body in such a state that the downstream side end of the sheet-like body is perpendicular to the conveying direction of the sheet-like body;

moving the blocking member at a position where the blocking member does not abut on the sheet-like body;

stopping travelling of the conveying member;

moving the conveying member in the direction perpendicular to the conveying direction until one side end of the sheet-like body in the direction perpendicular to the conveying direction reaches a predetermined position;

stopping the conveying member; and restarting travelling of the conveying member.

5. A method for locating and conveying a sheet-like body, comprising the steps of:

causing a downstream side end of a sheet-like body supported only at an underside thereof and conveyed by a travelling conveying member to abut against a blocking member to correct the attitude of the sheet-like member in such a state that the downstream side end of the sheet-like member is perpendicular to the conveying direction of the sheet-like member;

stopping travelling of the conveying member;

moving the conveying member in the direction perpendicular to the conveying direction until one side end portion of the sheet-like body in the direction perpendicular to the conveying direction reaches a predetermined position to stop the conveying member;

moving the blocking member at a position where the blocking member does not abut against the sheet-like body; and restarting travelling of the conveying member.

6. An apparatus for locating and conveying a sheet-like body, comprising:

a conveying member which supports a sheet-like body only at an underside thereof and conveys the same in a conveying direction by travelling thereof and which can reciprocate in an X direction perpendicular to the conveying direction;

a moving mechanism which reciprocates the conveying member in the X direction;

a blocking member which can reciprocate between a position where the blocking member abuts against the sheet-like body conveyed in the conveying direction by the conveying member to block conveyance of the sheet-like body and a position where the blocking member allows passing of the sheet-like body;

a first detector which detects whether or not the downstream side end of the sheet-like body is positioned to abut against the blocking member which stands by at a position where the blocking member prevents the conveyance;

a second detector which detects that one side end of the sheet-like body in the direction perpendicular to the conveying direction of the sheet-like body has reached the predetermined position by movement of the conveying member in the X direction effected by actuation of the moving mechanism;

a controller which performs such control that both of moving the blocking member at the position where the blocking member allows passing of the sheet-like body and actuating the moving mechanism to move the conveying member in the X direction are simultaneously performed or either one thereof is first performed on the basis of a signal form the first detector which has detected the downward side end of the sheet-like body conveyed by the conveying member in the state where the blocking member stands by at the position where the blocking member prevents the conveyance, and the moving mechanism is then stopped on the basis of a signal from the second detector which has detected the sheet-like body.

7. An apparatus for locating and conveying a sheet-like body, comprising:

a conveying member which supports a sheet-like body only at an underside thereof and conveys the same in a conveying direction by travelling, and can stop and reciprocate in an X direction perpendicular to the conveying direction;

a moving mechanism which reciprocates the conveying member in the X direction;

a blocking member which can reciprocate between a position where the blocking member abuts against the sheet-like body conveyed in the conveying direction by the conveying member to block conveyance of the sheet-like body and a position where the blocking member allows passing of the sheet-like body;

a first detector which detects whether or not the downstream side end of the sheet-like body is positioned to abut against the blocking member which stands by at a position where the blocking member prevents the conveyance;

a second detector which detects that one side end of the sheet-like body in the direction perpendicular to the conveying direction of the sheet-like body has reached the predetermined position by movement of the conveying member in the X direction effected by actuation of the moving mechanism; and a controller which performs such control that travelling of the conveying member is stopped on the basis of a signal from the first detector which has detected the downstream side end of the sheet-like body conveyed by the conveying member in the state where the blocking member stands by at the position where the blocking member prevents the conveyance, whereby after the blocking member has been moved at the position where the blocking member allows passing of the sheet-like body, restarting travelling of the conveying member and activating the moving mechanism to move the conveying member in the X direction are simultaneously performed or either one thereof is first performed, and the moving mechanism is stopped on the basis of a signal from the second detector which has detected the sheet-like body.

8. An apparatus for locating and conveying a sheet-like body, comprising:

a conveying member which supports a sheet-like body only at an underside thereof and conveys the same in a conveying direction by travelling, and can stop and reciprocate in an X direction perpendicular to the conveying direction;

a moving mechanism which reciprocates the conveying member in the X direction;

a blocking member which can reciprocate between a position where the blocking member abuts against the sheet-like body conveyed in the conveying direction by the conveying member to block conveyance of the sheet-like body and a position where the blocking member allows passing of the sheet-like body;

a first detector which detects whether or not the downstream side end of the sheet-like body is positioned to abut against the blocking member which stands by at a position where the blocking member prevents the conveyance;

a second detector which detects that one side end of the sheet-like body in the direction perpendicular to the conveying direction of the sheet-like body has reached the predetermined position by movement of the conveying member in the X direction effected by actuation of the moving mechanism; and a controller which performs such control that travelling of the conveying member is stopped on the basis of a signal from the first detector which has detected the downstream side end of the sheet-like body conveyed by the conveying member in the state where the blocking member stands by at the position where the blocking member prevents the conveyance, whereby after the blocking member has been moved at the position where the blocking member allows passing of the sheet-like body, the moving mechanism is actuated to move the conveying member in the X direction, and after the moving mechanism is stopped on the basis of a signal from the second detector which has detected the sheet-like body, travelling of the conveying member is restarted.

9. An apparatus for locating and conveying a sheet-like body according to any one of claims 6 to 8, wherein the conveying member comprises a plurality of disc-like rolls which have axial center lines extending in a direction perpendicular to the conveying direction and which are rotationally driven.

10. An apparatus for locating and conveying a sheet-like body according to any one of claims 6 to 8, wherein the conveying member comprises a plurality of disc-like rolls which have axial center lines extending in a direction perpendicular to the conveying direction and which are rotationally driven and, a pressing roll which can approach to/separate from at least one of the plurality of disc-like rolls from the above.

11. An apparatus for locating and conveying a sheet-like body according to any one of claims 6 to 8, wherein the conveying member comprises a plurality of disc-like rolls which have axial center lines extending in a direction perpendicular to the conveying direction and which are rotationally driven, and a pressing roll which can approach to/separate from at least one of the plurality of disc-like rolls from the above and which is rotated in a follow-up manner.

* * * * *